US008710915B2

(12) United States Patent
Ibuka

(10) Patent No.: US 8,710,915 B2
(45) Date of Patent: Apr. 29, 2014

(54) APPARATUS, ELECTRONIC COMPONENT AND METHOD FOR GENERATING REFERENCE VOLTAGE

(75) Inventor: Hiroshi Ibuka, Tokyo (JP)

(73) Assignee: NEC Corporation, Tokyo (JP)

( * ) Notice: Subject to any disclaimer, the term of this patent is extended or adjusted under 35 U.S.C. 154(b) by 401 days.

(21) Appl. No.: 12/216,968

(22) Filed: Jul. 14, 2008

(65) Prior Publication Data

US 2009/0051416 A1 Feb. 26, 2009

(30) Foreign Application Priority Data

Aug. 21, 2007 (JP) ..... 2007-215083

(51) Int. Cl.
*G05F 1/10* (2006.01)
*G05F 3/26* (2006.01)

(52) U.S. Cl.
CPC ..... *G05F 3/262* (2013.01)
USPC ..... 327/543

(58) Field of Classification Search
USPC ..... 327/103, 538, 540, 541, 543, 291, 295, 327/539; 323/312, 313, 314, 315, 316
See application file for complete search history.

(56) References Cited

U.S. PATENT DOCUMENTS

| | | | | |
|---|---|---|---|---|
| 6,798,245 | B2 * | 9/2004 | Ohmae | 326/82 |
| 7,061,307 | B2 * | 6/2006 | Iroaga | 327/541 |
| 7,573,323 | B2 * | 8/2009 | Moholt et al. | 327/538 |
| 2002/0163379 | A1 * | 11/2002 | Kimura | 327/540 |
| 2004/0108889 | A1 * | 6/2004 | Kizaki et al. | 327/541 |

FOREIGN PATENT DOCUMENTS

| | | | |
|---|---|---|---|
| JP | 6-274242 | A | 9/1994 |
| JP | 10-065515 | A | 3/1998 |

OTHER PUBLICATIONS

Japanese Office Action dated Jan. 31, 2012, with partial English translation.

* cited by examiner

*Primary Examiner* — Sibin Chen
(74) *Attorney, Agent, or Firm* — McGinn IP Law Group, PLLC

(57) ABSTRACT

An apparatus, includes a plurality of circuits each of which operates with a reference voltage, a constant current generator which generates a substantially constant current, and distributes the substantially constant current to each of the circuits, and a plurality of converters, each of the converters respectively corresponding to each of the circuits, each of which converts the substantially constant current to the reference voltage and respectively provides the reference voltage to each of the circuits.

20 Claims, 4 Drawing Sheets

RELATED ART

APPARATUS, ELECTRONIC COMPONENT AND METHOD FOR GENERATING REFERENCE VOLTAGE

This application is based upon and claims the benefit of priority from Japanese patent application No. 2007-215083, filed on Aug. 21, 2007, the disclosure of which is incorporated herein in its entirety by reference.

BACKGROUND OF THE INVENTION

1. Field of the Invention

The present invention relates to a reference voltage generation circuit and a reference voltage distributing method, and relates to a reference voltage generation circuit and a reference voltage distributing method which are favorable for use in the case of generating reference voltages to be applied to constant current sources included in non-saturation type logic circuits (e.g., CML, Current Mode Logic, or ECL, Emitter Coupled Logic) which are provided in an LSI (Large Scale Integrated Circuit) or the like including a number of circuits (e.g., flip-flops), and supply clocks to the respective circuits (e.g., flip-flops).

2. Description of Related Art

In an LSI including a number of flip-flops, it is necessary to prevent a malfunction of each of the flip-flops due to a deviation of the timing (clock skew) of a clock which is distributed and supplied to each of the flip-flops.

In FIG. 4, a clock is supplied to each flip-flop (not illustrated in FIG. 4), via a clock wiring 2, which is a tree structural wiring, from a clock supply source, which is installed outside an LSI 1. If clock delays become equal because of the structure of the clock wiring 2, then the clock skew becomes zero. In a high-speed serial transmission such as SerDes (Serialization/Deserialization), a high frequency clock is required. However, an edge shift of the high frequency clock (i.e., clock jitter) significantly influences the error rate of transmission.

Therefore, in recent years, a CML circuit or an ECL circuit which has a resistance against a power source is used as a clock driver. In such a clock driver, the CML circuit or an ECL circuit is configured by a MOS transistor capable of high-speed operation with a small amplitude.

The CML circuit and the ECL circuit is an analog circuit which requires a reference voltage. When a clock is distributed and supplied to the flip-flop by using such an analog circuit requiring the reference voltage as the clock driver in the region across a wide range of the LSI 1, if the reference voltage is distributed in a voltage mode, there arises a problem of being easily influenced by a crosstalk noise from a periphery of the LSI 1 and a noise caused by the CML or ECL circuit itself Another problem arises of a malfunction to a variation in the operation process of the LSI 1 or a gradient of the reference voltage of the LSI 1.

Further, when a shield wiring is installed to prevent the influence of the crosstalk noise, there arises another problem that an occupation area of a hardware configuration of the LSI 1 becomes larger and/or complex.

It is possible to install a feedback circuit to generate the reference voltage, the feedback circuit being configured by a replica circuit and an operational amplifier. In this case, since variation in the operation process of the LSI 1 can be cancelled and the distribution range of the reference voltage can be made narrow, the influence of the crosstalk noise will decrease. However, since the feedback circuit is needed to be installed corresponding to each of the clock drivers, the occupation area for the feedback circuit will be increased.

Further, since a plurality of loops of the feedback circuits exist in the LSI 1 and a state in which the operations differ among the respective feedback circuits easily occurs, therefore, this configuration easily causes the clock skew and the clock jitter.

As the related art, for example, there is a Patent Document 1.

In a differential output driver described in Patent Document 1, a constant current generator is provided at one spot inside an integrated circuit chip. The constant current generator distributes a reference current to each of the differential output driver in the integrated circuit chip, and a differential signal output unit is controlled by the reference current. The reference current which is distributed by the constant current generator is inputted into a first current mirror circuit The output current of the first current mirror circuit is inputted into a second current mirror circuit. The output current of the second current mirror circuit is inputted into the differential signal output unit.

[Patent Document 1] Japanese Patent Laid-Open No. 10-065515

SUMMARY OF THE INVENTION

According to one exemplary aspect of the present invention, an apparatus, includes: a plurality of circuits each of which operates with a reference voltage, a constant current generator which generates a substantially constant current, and distributes the substantially constant current to each of the circuits, and a plurality of converters, each of the converters respectively corresponding to each of the circuits, each of which converts the substantially constant current to the reference voltage and respectively provides the reference voltage to each of the circuits.

According to another exemplary aspect of the present invention, an electronic component, includes: a plurality of circuits each of which operates with a reference voltage, a constant current generator which generates a substantially constant current, and distributes the substantially constant current to each of the circuits, and a plurality of converters, each of the converters respectively corresponding to each of the circuits, each of which converts the substantially constant current to the reference voltage and respectively provides the reference voltage to each of the circuits.

According to another exemplary aspect of the present invention, a method for operating a plurality of circuits with a reference voltage, includes: generating a substantially constant current, distributing the substantially constant current to each of the circuits, converting the substantially constant current to the reference voltage by a plurality of converters, each of the converters respectively corresponding to each of the circuits, and providing the reference voltage to each of the circuits.

BRIEF DESCRIPTION OF THE DRAWINGS

Other exemplary aspects and advantages of the invention will be made more apparent by the following detailed description and the accompanying drawings, wherein.

DETAILED DESCRIPTION OF THE EXEMPLARY EMBODIMENT

Figure 1:
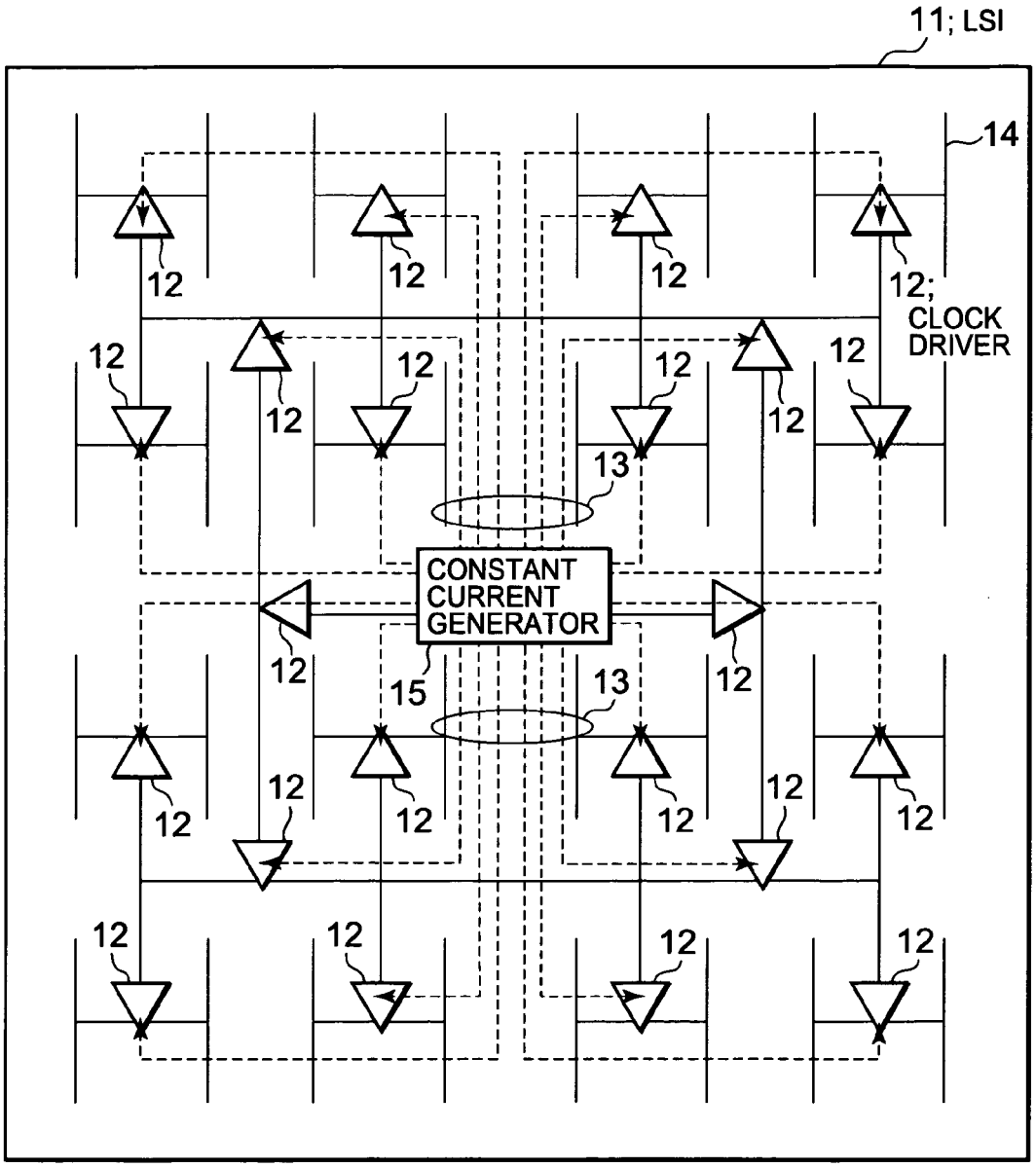
FIG. 1 is a schematic view showing a configuration of an LSI of the present invention.

In the differential output driver described in Patent Document 1, the output current of the second current mirror circuit flows into the differential output stage, and therefore, it differs from the present invention in hardware configuration.

The present invention is made in view of the above described circumstances, and includes a feature to provide an apparatus, an electronic component and method for generating a reference voltage in which a clock skew and a clock jitter are reduced.

A constant current generator generates a substantially constant current for each of circuits (e.g., clock drivers), and distributes the substantially constant current to each of the circuits (e.g., the clock drivers) via each of wirings. A plurality of converters convert the substantially constant current into a reference voltage. The converters correspond to each of the circuits (e.g., the clock drivers). For example, the converters maybe installed inside each of the circuits (e.g., the clock drivers), or in the vicinity of each of circuits (e.g., the clock drivers). The converters distribute the reference voltage to the circuits (e.g., the clock drivers) and apply the reference voltage to a constant current source of each of the circuits (e.g., the clock drivers). The substantially constant current flows into the constant current source, whereby transistors in a differential amplifying circuit configuring each of the circuits (e.g., the clock drivers) such as a CML or ECL operate in a non-saturation condition, and occurrence of a clock skew and jitter is suppressed.

Further, the plurality of circuits (e.g., the clock drivers) are dispersed in an integrated circuit or a circuit board. The constant current generator has a plurality of current output elements which output the respective substantially constant currents to the respective circuits (e.g., the clock drivers). The respective converters are respectively disposed in a vicinity of or inside the respective circuits (e.g., the clock drivers). The respective converters are connected to the respective current output elements of the constant current generator via respective wirings.

In other words, the respective converters and the respective current output elements of the constant current generator are connected by one-to-one connection. Thus, even though the respective circuits (e.g., the clock drivers) are dispersed inside the integrated circuit, the gradient of the reference voltage does not occur in the integrated circuit, and the influence of a crosstalk noise and a noise which is caused by the circuits (e.g., the clock drivers) itself can be reduced. Therefore, a shield wiring is not needed, and therefore, an occupation area of the hardware configuration can be reduced.

Further, each of the respective current output elements has a first transistor for outputting a current, and a current control element which controls the current outputted from the first transistor to be the constant current by operating the first transistor in the saturation condition.

Further, each of the respective circuits (e.g., the clock drivers) is configured by a non-saturation type logic circuit, and the non-saturation type logic circuit has a constant current source in which a substantially constant current flows by the application of the reference voltage, and a second transistor which operates in a non-saturation condition by the substantially constant current flowing from the current source.

Further, a plurality of sequential circuits are provided in the integrated circuit or circuit board, and the non-saturation type logic circuit is configured to supply a clock to each of respective sequential circuits (e.g., flip-flop circuits) via a clock wiring in a state in which the substantially constant current flows into the constant current source.

FIG. 1 shows an exemplary embodiment of the present invention.

An LSI 11 includes clock drivers 12, wirings 13, a clock wiring 14 and a constant current generator 15. Each of the clock drivers 12 is dispersed in the LSI 11. Each of the clock drivers 12 operates in the state in which the reference voltage is applied. Especially in the exemplary embodiment, each of the clock drivers 12 may be configured by a non-saturation type logic circuit such as a CML, and the CML includes the constant current source. The substantially constant current flows into the constant current source by the application of the reference voltage. The CML includes a transistor which operates in a non-saturation condition by the substantially constant current which flows from the constant current source.

Further, the converter is installed in the vicinity of, or inside, each of the clock drivers 12. The converter converts the substantially constant current generated in the constant current generator 15 into a reference voltage, and applies the reference voltage to the constant current source.

A flip-flop (a sequential circuit) is connected to the output side of each of the clock drivers 12 via, for example, the H-tree type clock wirings 14, and the CML of each of the clock drivers 12 supplies the clock to each of the flip-flops via each of the clock wirings 14 in the state in which the substantially constant current flows into the constant current source. Each of the flip-flops is installed in the internal region of the LSI 11, for example.

The constant current generator 15 is disposed in the vicinity of substantially the center of the LSI 11. The constant current generator 15 generates the substantially constant current to be converted into the reference voltage which is applied to the constant current source of each of the clock drivers 12. The constant current generator 15 distributes the substantially constant current to each of the clock drivers 12 from a current output part of the constant current generator 15. The respective current output elements are connected to the converters of the respective clock drivers 12 with one-to-one connection via each of wirings 13.

Figure 2:
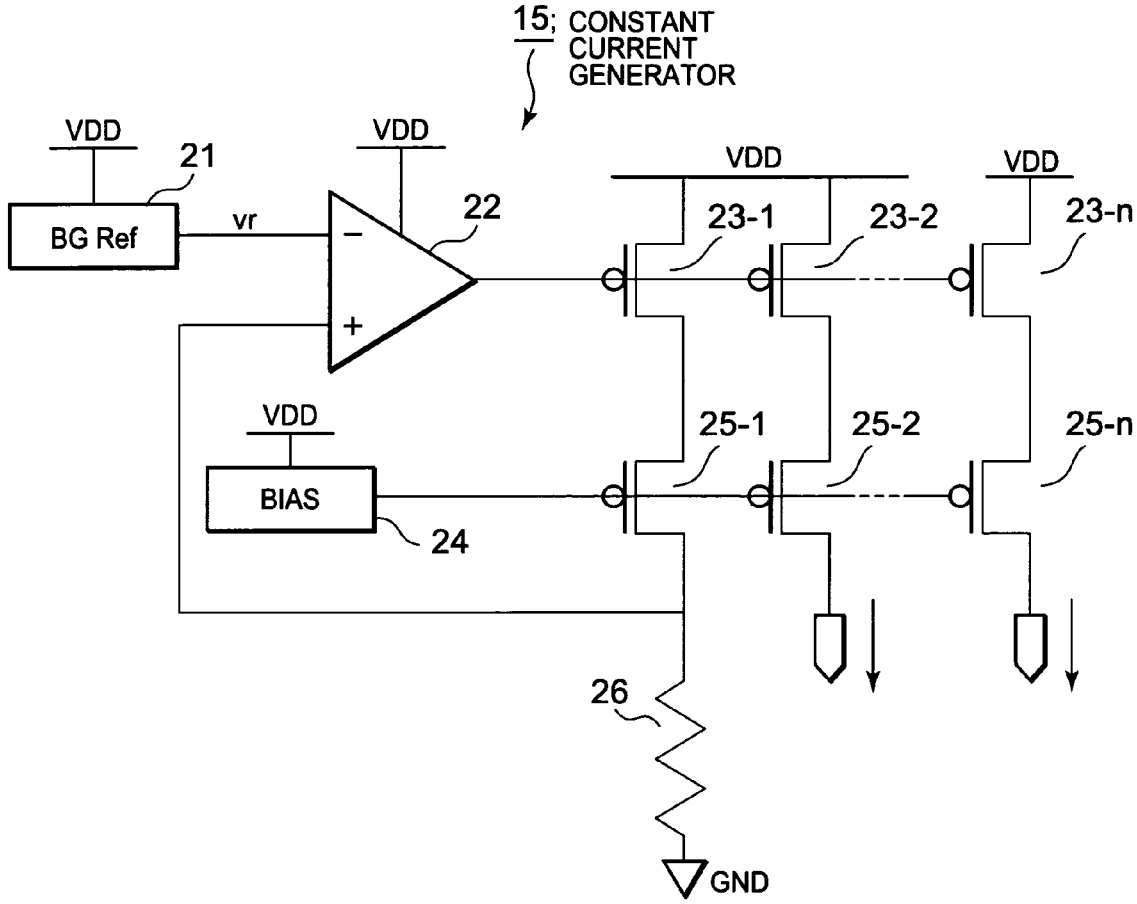
FIG. 2 is a circuit diagram of a constant current generator.

FIG. 2 is a circuit diagram showing the electric configuration of the main part of the constant current generator 15 in FIG. 1.

The constant current generator 15 includes a band gap reference (BG Ref) 21, an operational amplifier 22, PMOS (p-channel type MOS transistors) 23-1, 23-2, . . . , **23-*n* ("n−1" is the same number as the number of the clock drivers 12), a bias circuit (BIAS) 24, pMOS 25-1, 25-2, . . . , 25-*n*, and a reference resistance 26, as shown in FIG. 2**.

Each of wirings 13 shown in FIG. 1 is connected to the drains of the PMOS 25-2, . . . , **25-*n*, respectively. In the constant current generator 15, a criterion voltage vr which is stable with high accuracy with respect to the ambient temperature change is generated by the band gap reference 21. Subsequently, a detection voltage vd generated by the current amount corresponding to a reference resistance 26 is fed back to the operational amplifier 22 and is compared with the reference voltage vr. Then, the pMOS 23-1, 23-2, . . . , 23-*n* operate in the saturation condition with a gate voltage controlled by the operational amplifier 22. Further, the pMOS 25-1, 25-2, . . . , 25-*n* operate in the saturation condition with a gate voltage controlled by the bias circuit 24. Thereby, a characteristic of the substantially constant current is enhanced, the transmission the change in the temperature characteristics of the PMOS 23-2, . . . , 23-*n* to the output sides (namely, the drains of the pMOS 25-2, . . . , 25-*n***) is prevented, and each substantially constant current IREF is outputted stably.

Figure 3:
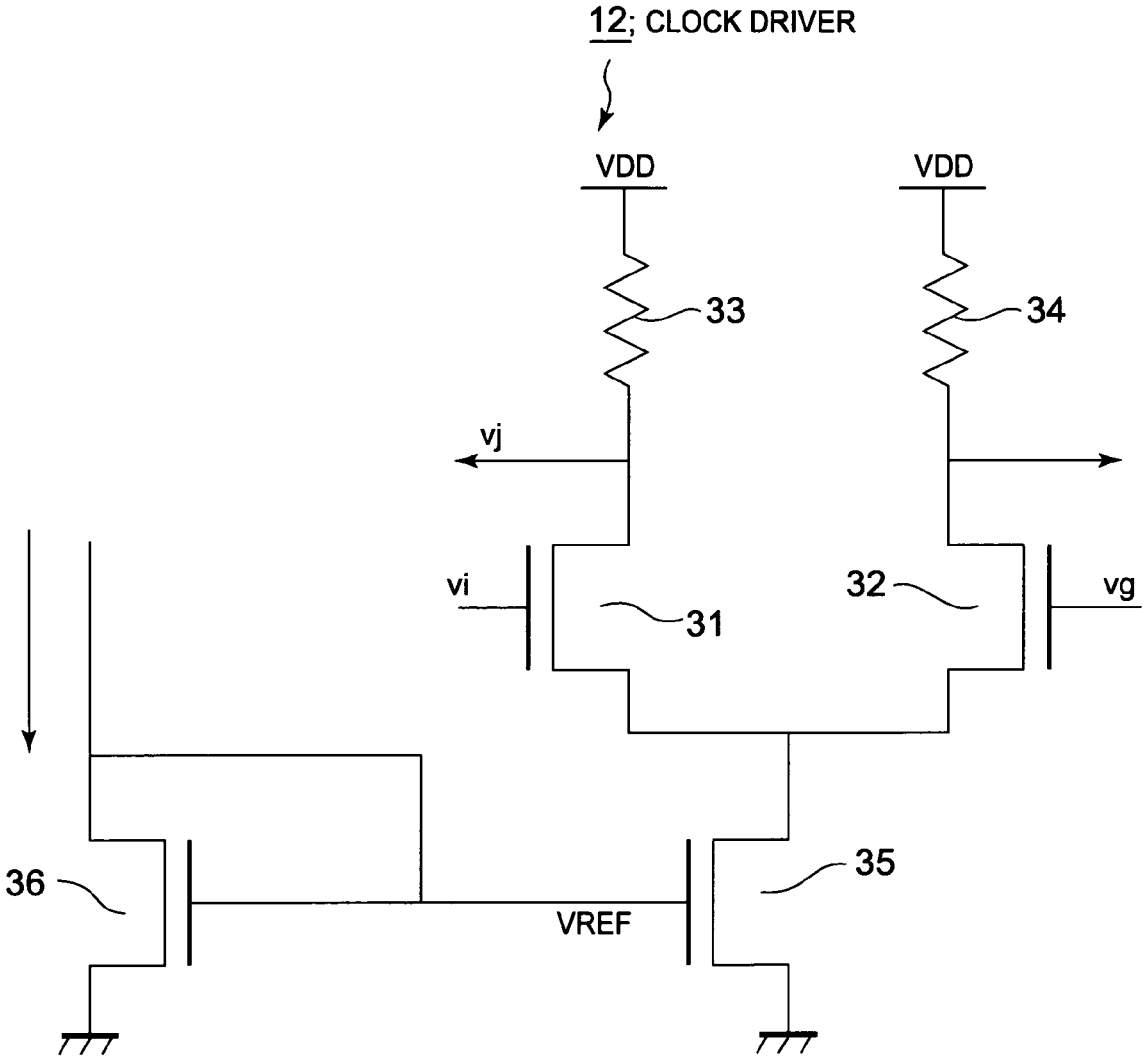
FIG. 3 is a circuit diagram of a clock driver.
Figure 4:
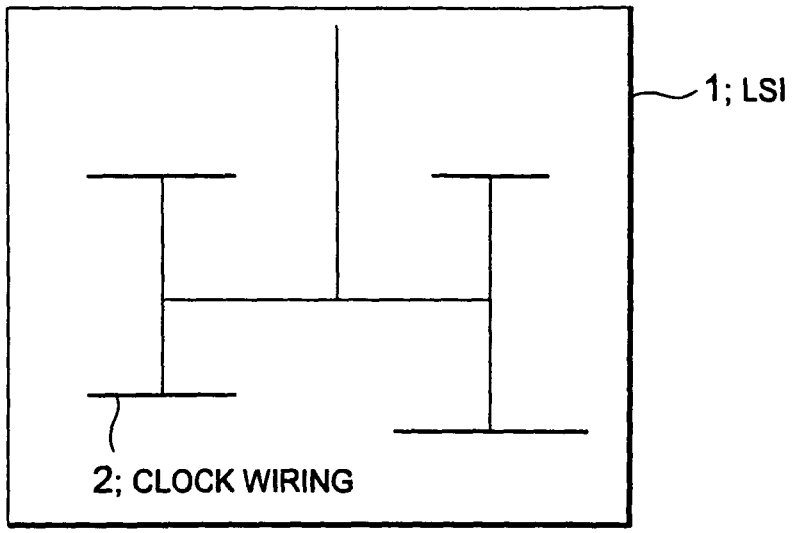
FIG. 4 is a diagram showing a configuration of the related art.

FIG. 3 shows an exemplary configuration of the clock drivers 12.

The clock driver 12 includes nMOS (n-channel type MOS transistors) 31 and 32, resistances 33 and 34, and nMOS 35 and 36. The substantially constant current IREF is supplied to the diode-connected nMOS 36 from the constant current generator 15 via the wiring 13. The substantially constant current IREF is converted into a reference voltage VREF. In other words, the nMOS 36 works as the converter.

The reference voltage VREF is applied to a gate electrode of the nMOS 35. The substantially constant current flows on the clock driver 12 via the nMOS 35. The nMOS 31 and 32 operate in the non-saturation condition by the substantially constant current. When an input voltage vi is applied to a gate electrode of the nMOS 31, and a criterion voltage vg is applied to a gate electrode of the nMOS 32, if the input voltage vi is higher than the criterion voltage vg, then an output voltage vj is outputted from the drain electrode of the nMOS 31.

Next, the process of distribution of the reference voltage will be described.

The constant current generator 15 generates the substantially constant current IREF to be converted into the reference voltage VREF, and distributes the substantially constant current IREF to each of the clock drivers 12 via each of the wirings 13.

Each of the substantially constant current IREF is converted into the reference voltage VREF by the diode-connected nMOS 36 (the converter), and is distributed and applied to the gate electrode of the nMOS 35 (the constant current source). Subsequently, the substantially constant current flows into the nMOS 35, and the nMOS 31 and 32 operate in the non-saturation condition.

An upper limit of the wiring length of each of the wirings 13 is determined based on the wiring resistance value which corresponds to a distance from the drains of each of the pMOS 25-2, . . . , **25-*n* to each of the clock drivers 12. In order to secure the characteristic of substantially constant current generated by the constant current generator 15, the pMOS 23-2, . . . , 23-*n* and the pMOS 25-2, . . . , 25-*n*** need to operate in the saturation condition.

However, if the wiring length of each of the wirings 13 becomes long, the voltage levels of the drains of the pMOS 25-2, . . . , **25-*n* become high due to a voltage drop caused by the resistances of each of the wirings 13. Then, the operation condition of the pMOS 23-2, . . . , 23-*n* and the pMOS 25-2, . . . , 25-*n*** shifts from the saturation condition to non-saturation condition, whereby the substantially constant current cannot be kept.

A boundary value in which the operation condition shifts from the saturation condition to the non-saturation condition is defined as a upper limit value of the wiring resistance value of each of the wirings 13. The upper limit value is determined based on a ratio of diffusion lengths and gate lengths of each of the pMOS 23-2, . . . , **23-*n* and pMOS 25-2, . . . , 25-*n*. Therefore, the upper limit value is adjustable by changing the ratio. As long as the pMOS 23-2, . . . , 23-*n* and the pMOS 25-2, 25-*n* operate within the range of the saturation condition, the resistance value of each of the wirings 13** may be changed. In addition, the reference voltage is strong against noise as compared with the method for distributing the reference voltage by a voltage mode.

In other words, the reference voltage which is distributed as the substantially constant current and then converted to the reference voltage has higher resistance against the noise than the reference voltage which is distributed by the voltage mode. Therefore, by setting the upper limit of the resistance value of each of the wirings 13, automatic wiring by using a tool such as CAD (Computer Aided Design) is possible.

In the exemplary embodiment, the substantially constant current IREF is generated for each of the clock drivers 12 by the constant current generator 15, and is distributed via each of the wirings 13. The substantially constant current IREF is converted into the reference voltage VREF by the diode-connected nMOS 36 (the converter), and is distributed and applied to the gate electrode of the nMOS 35 (the constant current source). Then, the substantially constant current flows into the nMOS 35, and the nMOS 31 and 32 operate in the non-saturation condition.

Thereby, even if each of the clock drivers 12 is dispersed in the LSI 11, the influence of the noise to the reference voltage VREF is suppressed, and a shield for preventing the noise is not required. Further, the circuit area of the LSI 11 does not have to be made large. Further, as compared with the case of distributing the reference voltage by the voltage mode, variation in the reference voltage is reduced, and occurrence of a clock skew and jitter is suppressed.

Further, since each of the current output elements of the constant current generator 15 are connected to each of the converters of each of the clock drivers 12 via each of the wirings 13 with one-to-one connection, the present invention can prevent the noise to the clock driver 12, and the noise caused by other clock drivers 12. Further, the resistance value of each of the wirings 13 is modifiable as long as the pMOS 23-2, . . . , **23-*n* and pMOS 25-2, . . . , 25-*n* operate in the saturation condition. Therefore, a thickness of wiring layer, a wiring width, and a wiring length are modifiable as long as the pMOS 23-2, . . . , 23-*n* and pMOS 25-2, . . . , 25-*n*** operate in the saturation condition. Further, a redundancy wiring for adjusting the wiring length is not required. Thus, the hardware configuration relating to the wirings is reduced.

The exemplary embodiment of the present invention is described in detail with reference to the drawings. However, the configuration is not limited to the exemplary embodiment.

For example, each of the clock wirings 14 shown in FIG. 1 is formed to be of an H-tree type, but the shape of the clock wiring may be modified optionally. Further, each of the flip-flops, which is connected to the output side of each of the clock drivers 12 via each of the clock wirings 14, is provided in the internal region of the LSI 11. However, the flip-flops may be installed in an I/O region. The design of each of the wirings 13 is not limited to automatic wiring using a tool such as CAD, but may be designed manually, as long as the upper limit of the resistance value is set.

Further, in the exemplary embodiment, components for generating the reference voltage are provided in the LSI 11, but may be provided in an optional circuit board. Further, the reference resistance 26 shown in FIG. 2 may be externally attached to the LSI 11. Further, each pMOS shown in FIG. 2 and each nMOS shown in FIG. 3 may be bipolar transistors respectively having the equivalent functions.

Further, the nMOS 36 (the converter) shown in FIG. 3 is provided inside the clock driver 12, but the nMOS 36 may be provided outside the clock driver 12 and in the vicinity of nMOS 35. Further, the clock driver 12 shown in FIG. 3 is configured as a CML, but may be configured as an ECL by connecting a source follower or an emitter follower to each of the drain electrodes of the nMOS 31 and 32.

Further, in the constant current generator 15 shown in FIG. 2, the operation and effect in accordance with the above described exemplary embodiment are obtained even if the bias circuit 24 and pMOS 25-1, 25-2, . . . , **25-*n*** are deleted.

Further, the constant current generator 15 shown in FIG. 2 and the clock driver 12 shown in FIG. 3 are not limited to the circuit configurations of the above described exemplary embodiment.

According to the configuration of the present invention, by the constant current generator, the substantially constant current is generated for each of the electronic circuits (i.e., the clock drivers), and each of the substantially constant currents generated in the constant current generator is converted into each of the reference voltages to be applied to each of the electronic circuits (i.e., the clock drivers) by each of the converters. Therefore, variation of the reference voltage does not occur, and an operation can be performed in the state in which each of the reference voltages is stably applied in each of the electronic circuits (i.e., the clock drivers).

Further, it is noted that applicant's intent is to encompass equivalents of all claim elements, even if amended later during prosecution.

What is claimed is:

1. An apparatus, comprising:

a plurality of circuits, each of which operates with a reference voltage;

a constant current generator which includes a band gap reference circuit configured to generate a criterion voltage for a first pMOS (p-channel type Metal-Oxide-Semiconductor) transistor and a bias circuit configured to generate a gate voltage for a second pMOS transistor operating in a saturation condition, the constant current generator generating a substantially constant current and distributing said substantially constant current to each of said circuits; and a plurality of converters, each of said converters respectively corresponding to each of said circuits, each of which converts said substantially constant current to said reference voltage and respectively provides said reference voltage to each of said circuits, wherein respectively corresponding first pMOS and second pMOS transistors are serially cascaded, and wherein said second pMOS transistor outputs said substantially constant current to each of said converters.

2. The apparatus according to claim 1, further comprising a plurality of wirings, each of which connects said constant current generator and each of said circuits.

3. The apparatus according to claim 2, wherein said constant current generator includes a transistor which operates under the saturation condition, and wherein each of said wirings comprises a length so that said transistor operates under said saturation condition.

4. The apparatus according to claim 1, further comprising a plurality of wirings, each of which connects said constant current generator and each of said converters.

5. The apparatus according to claim 1, wherein said converter is installed inside of each of said circuits.

6. The apparatus according to claim 1, wherein said converter is installed in a vicinity of each of said circuits.

7. The apparatus according to claim 1, wherein said constant current generator is surrounded with said circuits.

8. The apparatus according to claim 1, wherein said constant current generator includes a transistor which operates under the saturation condition.

9. An electronic component, comprising:

a plurality of circuits, each of which operates with a reference voltage;

a constant current generator which includes a band gap reference circuit configured to generate a criterion voltage for a first pMOS (p-channel type Metal-Oxide-Semiconductor) transistor and a bias circuit configured to generate a gate voltage for a second pMOS transistor operating in a saturation condition, said constant current generator generating a substantially constant current and distributing said substantially constant current to each of said circuits; and a plurality of converters, each of said converters respectively corresponding to each of said circuits, each of which converts said substantially constant current to said reference voltage and respectively provides said reference voltage to each of said circuits, wherein respectively corresponding first pMOS and second pMOS transistors are serially cascaded, and wherein said second pMOS transistor outputs said substantially constant current to each of said converters.

10. The electronic component according to claim 9, further comprising a plurality of wirings, each of which connects said constant current generator and each of said circuits.

11. The electronic component according to claim 10, wherein said constant current generator includes a transistor which operates under the saturation condition, and wherein a length of each of said wirings comprises a length so that said transistor operates under said saturation condition.

12. The electronic component according to claim 9, further comprising a plurality of wirings, each of which connects said constant current generator and each of said converters.

13. The electronic component according to claim 9, wherein said converter is installed inside of each of said circuits.

14. The electronic component according to claim 9, wherein said converter is installed in a vicinity of each of said circuits.

15. The electronic component according to claim 9, wherein said constant current generator is surrounded with said circuits.

16. The electronic component according to claim 9, wherein said constant current generator includes a transistor which operates under the saturation condition.

17. A large scale integrated circuit, comprising:

a plurality of clock drivers, each of which operates with a reference voltage;

a constant current generator configured to generate a substantially constant current and to distribute said substantially constant current to each of said clock drivers, said constant current generator including:

a plurality of first pMOS (p-channel type Metal-Oxide-Semiconductor) transistors;

a plurality of second pMOS transistors serially cascaded with said plurality of first pMOS transistors; and a band gap reference circuit configured to generate a criterion voltage for said first plurality of pMOS transistors;

a bias circuit configured to generate a gate voltage for said plurality of second pMOS transistors operating in a saturation condition, the constant current generator generating a substantially constant current and distributing said substantially constant current to each of said clock drivers; and a plurality of converters, each of said converters respectively corresponding to a respective one of said clock drivers, each of said converters converting said substantially constant current to said reference voltage and respectively providing said reference voltage to each of said clock drivers, wherein each of; plurality of wirings is connected to a drain of a respective one of the second pMOS transistors, and wherein said second pMOS transistors output said substantially constant current to each of, said converters.

18. The apparatus according to claim 17, wherein the constant current generator further comprises:

a reference resistance serially connected between a ground and one of said serially cascaded first pMOS transistors and second pMOS transistors; and an operational amplifier receiving said criterion voltage from said band gap reference and which compares the criterion voltage to a detection voltage generated by a current amount to the reference resistance.

19. The apparatus according to claim 18, wherein a gate voltage supplied to the first pMOS transistors is controlled by the operational amplifier, and wherein the first pMOS transistors operate in the saturation condition.

20. The apparatus according to claim 17, wherein wherein the second pMOS transistors operate in the saturation condition with a gate voltage controlled by the bias circuit.

* * * * *